US005653199A

United States Patent [19]

Ishiuchi et al.

[11] Patent Number: 5,653,199

[45] Date of Patent: Aug. 5, 1997

[54] AUTOMATIC DECOMPRESSION DEVICE FOR AN ENGINE

[75] Inventors: Yukio Ishiuchi; Hiroyuki Kakinuma; Yuji Ono, all of Saitama, Japan

[73] Assignee: Honda Giken Kogyo Kabushiki Kaisha, Tokyo, Japan

[21] Appl. No.: 501,653

[22] Filed: Jul. 12, 1995

[30] Foreign Application Priority Data

Jul. 12, 1994 [JP] Japan ..... 6-160317

[51] Int. Cl.[6] ..... F01L 13/08

[52] U.S. Cl. ..... 123/182.1

[58] Field of Search ..... 123/182.1

[56] References Cited

U.S. PATENT DOCUMENTS 4,790,271 12/1988 Onda ..... 123/182.1

FOREIGN PATENT DOCUMENTS 3-39167 6/1991 Japan .

4-191408 7/1992 Japan ..... 123/182.2

*Primary Examiner*—Andrew M. Dolinar

*Attorney, Agent, or Firm*—Birch, Stewart, Kolasch & Birch, LLP

[57] ABSTRACT

In an automatic decompression device for an engine, having a decompression cam supported on a camshaft adjacent to a valve operating cam for movement between a biased valve opening position in which the decompression cam causes a cam surface to project beyond a base circle portion of the valve operating cam to bias open an exhaust valve or an intake valve in a compression stroke of the engine, and a retracted position in which the decompression cam retracts the cam surface inwardly of the base circle portion of the valve operating cam under centrifugal forces acting on the counterweight against spring forces of a spring when the engine operates at a relatively high rotational speed, to prevent oil from being trapped between the decompression cam and the camshaft and allow the decompression cam to operate smoothly to decompress the engine when the engine starts at low temperatures. A decompression cam includes a plurality of recesses defined at circumferentially spaced intervals on the inner circumferential surface of the decompression cam, the recesses define therebetween lands for limiting the range of movement of the decompression cam in a plane perpendicular to the axis of a camshaft.

56 Claims, 6 Drawing Sheets

AUTOMATIC DECOMPRESSION DEVICE FOR AN ENGINE

BACKGROUND OF THE INVENTION

1. Field of the Invention

The present invention relates to an automatic decompression device for an engine, including a camshaft having a valve operating cam for moving a cam follower operatively coupled to an exhaust valve or an intake valve.

A decompression cam includes a ring shape surrounding the camshaft adjacent to the valve operating cam and includes a cam surface engageable with the cam follower at a position corresponding to a base circle portion of the valve operating cam and a counterweight shaped out of contact with the cam follower and disposed substantially opposite to the cam surface across the axis of the camshaft. A spring is disposed under compression between the camshaft and the decompression cam for normally urging the decompression cam in a direction to cause the cam surface to project beyond the base circle portion of the valve operating cam. The decompression cam is supported on the camshaft for movement between a biased valve opening position in which the decompression cam causes the cam surface to project beyond the base circle portion of the valve operating cam to bias open the exhaust valve or the intake valve in a compression stroke of the engine. A retracted position in which the decompression cam retracts the cam surface inwardly of the base circle portion of the valve operating cam under centrifugal forces acting on the counterweight against spring forces of the spring when the engine operates at a relatively high rotational speed.

2. Description of Background Art

An automatic decompression device is described in Japanese Patent Publication No. 3-39167.

In the conventional automatic decompression device, the ring shaped compression cam has a hole having an inside diameter slightly larger than the outside diameter of the camshaft. The camshaft is loosely fitted in the hole to allow the compression cam to move between the biased valve opened position and the retracted position. There is only a relatively small clearance defined circumferentially between the camshaft and the decompression cam. When the engine is shut off, oil tends to be trapped in the clearance, and its viscosity increases as the ambient temperature decreases. Therefore, when the engine starts at low temperatures, the decompression cam may not operate smoothly due to the viscosity resistance imposed by the oil.

SUMMARY AND OBJECTS OF THE INVENTION

The present invention has been achieved in view of the above problem. It is an object of the present invention to provide an automatic decompression device for an engine, which is allowed to operate smoothly to decompress the engine when the engine starts at a low temperature.

To achieve the above object, there is provided in accordance with the invention an automatic decompression device for an engine including a camshaft having a valve operating cam for moving a cam follower operatively coupled to an exhaust valve or an intake valve. A decompression cam has a ring shape surrounding the camshaft adjacent to the valve operating cam and includes a cam surface engageable with the cam follower at a position corresponding to a base circle portion of the valve operating cam and a counterweight shaped out of contact with the cam follower and disposed substantially opposite to the cam surface across the axis of the camshaft. A spring is disposed under compression between the camshaft and the decompression cam for normally urging the decompression cam in a direction to cause the cam surface to project beyond the base circle portion of the valve operating cam. The decompression cam is supported on the camshaft for movement between a biased valve opening position in which the decompression cam causes the cam surface to project beyond the base circle portion of the valve operating cam to bias open the exhaust valve or the intake valve in a compression stroke of the engine and a retracted position in which the decompression cam retracts the cam surface inwardly of the base circle portion of the valve operating cam under centrifugal forces acting on the counterweight against spring forces of the spring when the engine operates at a relatively high rotational speed. The decompression cam has a plurality of recesses defined at circumferentially spaced positions in inner circumferentially spaced positions on an inner circumferential surface thereof. The recesses form therebetween a plurality of lands for limiting the range of movement of the decompression cam in a plane perpendicular to the axis of the camshaft.

In addition, the arrangement of the recesses of the decompression cam are open outwardly at at least one end thereof along the axis of the camshaft.

According to the invention, the decompression cam is supported on the camshaft while being limited against axial movement by the valve operating cam and a bearing interposed between a support of an engine body and the camshaft. The counterweight is disposed between the valve operating cam and the bearing and has oil discharge passages having inner ends communicating with the recesses defined in an inner circumferential surface of the counterweight and outer ends opening at an outer circumferential surface of the counterweight.

According to the invention, the plurality of recesses are defined at circumferentially spaced intervals in the inner circumferential surface of the decompression cam, the recesses defining therebetween the lands for limiting the range of movement of the decompression cam in a plane perpendicular to the axis of the camshaft. Any clearance created between the camshaft and the decompression cam is relatively large for minimizing any trapped oil, and the decompression cam operates smoothly to decompress the engine when the engine starts at low temperatures.

According to the invention, the recesses of the decompression cam are open outwardly at at least one end thereof along the axis of the camshaft. Therefore, the discharge of oil from the recesses is promoted, effectively preventing oil from being trapped.

The decompression cam is supported on the camshaft while being limited against axial movement by the valve operating cam and a bearing interposed between a support of an engine body and the camshaft, and the counterweight is disposed between the valve operating cam and the bearing and has oil discharge passages having inner ends communicating with the recesses defined in an inner circumferential surface of the counterweight and outer ends opening at an outer circumferential surface of the counterweight. Even though the ends of the recesses defined in the counterweight are closed by the valve operating cam or the bearing, oil can effectively be discharged from the oil discharge passages.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
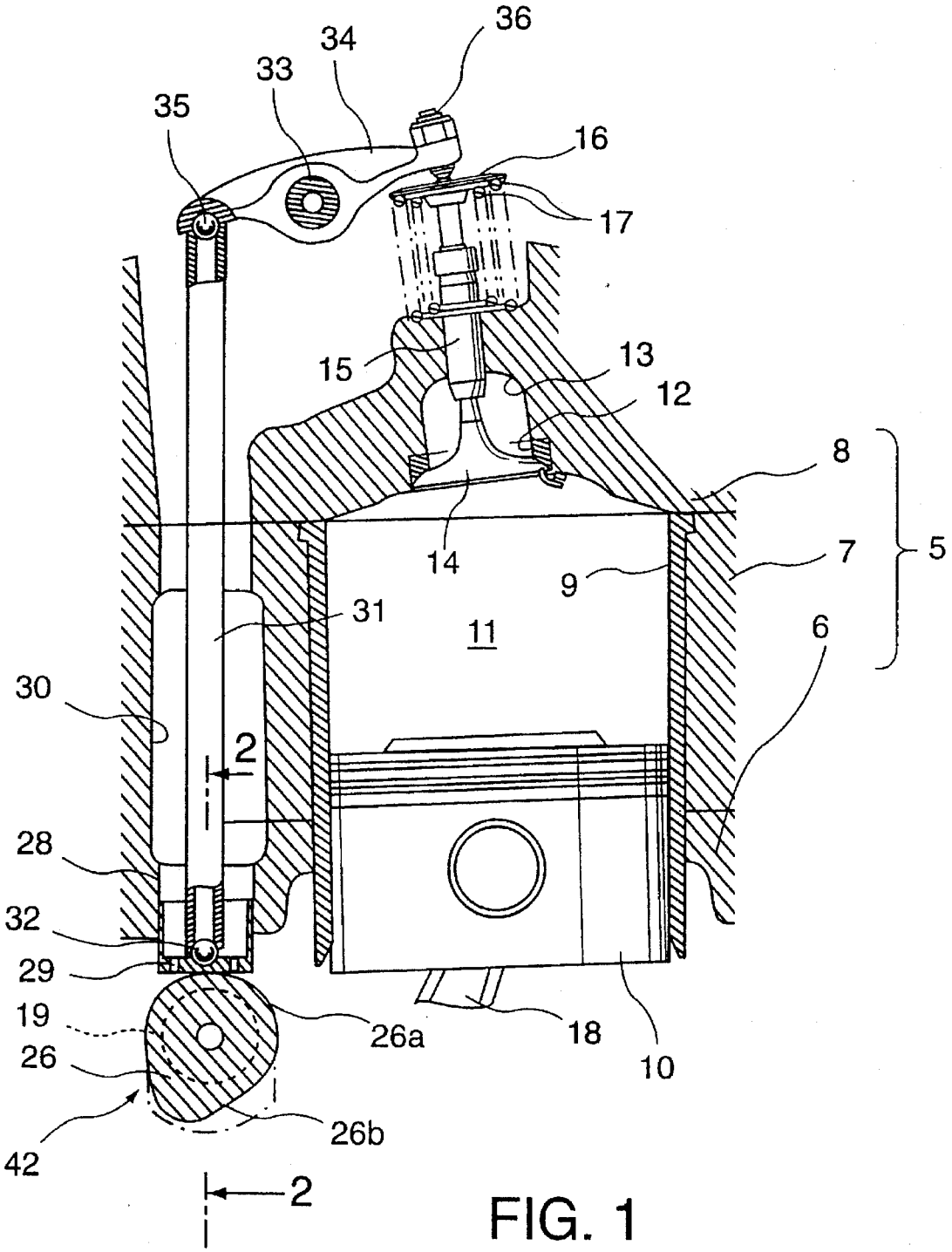
FIG. 1 is a fragmentary vertical cross-sectional view of a portion of an engine.
Figure 2:
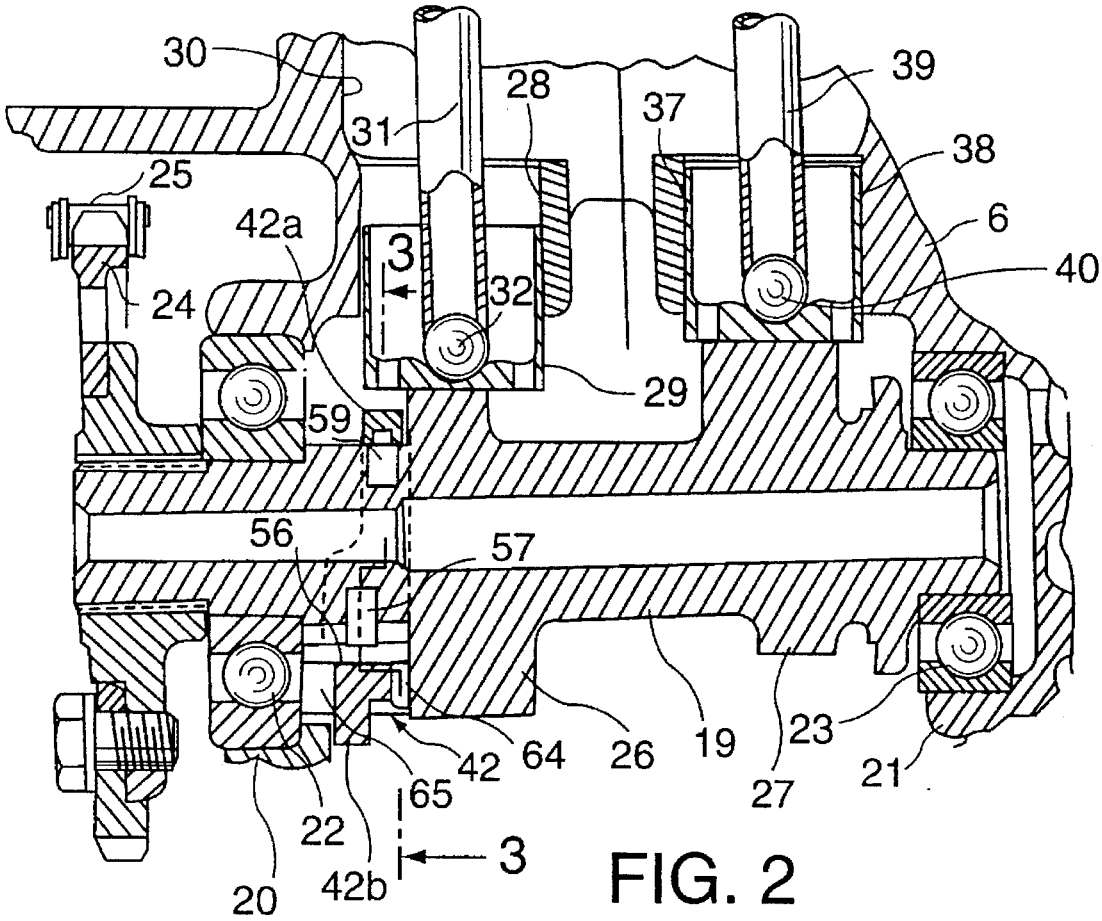
FIG. 2 is an enlarged cross-sectional view taken along line 2—2 of FIG. 1.

As shown in FIGS. 1 and 2, a multi-cylinder engine includes an engine body 5 which comprises a crankcase 6, a cylinder block 7 coupled to the upper surface of the crankcase 6 and a cylinder head 8 coupled to the upper surface of the cylinder block 7. The engine body 5 also includes a combustion chamber 11 defined between the cylinder head 8 and a piston 10 slidably fitted in a sleeve 9 which extends into the crankcase 6 and is coupled to the cylinder block 7. The cylinder head 8 has an exhaust valve hole 12 defined therein which is open at the top of the combustion chamber 11. An exhaust port 13 communicates with the exhaust valve hole 12, an intake valve hole (not shown) defined therein which is open at the top of the combustion chamber 11. An exhaust port (not shown) communicates with the intake valve hole.

A guide tube 15 for guiding movement of the exhaust valve 14 to open and close the exhaust valve hole 12 is fixedly mounted in the cylinder head 8. A valve spring 17 for normally urging the exhaust valve 14 to move upwardly, i.e., in a valve closing direction is disposed under compression between the cylinder head 8 and a retainer 16 mounted on the upper end of the exhaust valve 14 which projects from the guide tube 15.

The crankcase 6 accommodates therein a camshaft 19 having its axis extending parallel to a crankshaft (not shown) this is connected to the piston 10 by a connecting rod 18. The camshaft 19 is rotatably supported on a pair of supports 20, 21 of the crankcase 6 by respective bearings 22, 23. A sprocket wheel 24 is fixed to an end of the camshaft 19 which projects from one of the supports 20. Rotational power from the crankshaft is transmitted to the camshaft 19 at a speed reduction ratio of ½ through a chain 25 that is trained around the sprocket wheel 24. The camshaft 19 has an exhaust valve operating cam 26 and an intake valve operating cam 27 formed integrally therewith at an axially spaced interval between the supports 20, 21.

The crankcase 6 has a guide hole 28 defined in a region thereof aligned with the exhaust valve operating cam 26. The guide hole 28 extends perpendicularly to the axis of the camshaft 19. A tappet 29 serves as a follower held in abutment against the exhaust valve operating cam 26 is slidably fitted in the guide hole 28. The crankcase 6, the cylinder block 7 and the cylinder head 8 jointly have a through hole 30 communicating with the guide hole 28. The through hole 30 houses therein an axially movable pushrod 31 which has a lower end fixed to a ball 32 held against the tappet 29. The upper end of the pushrod 31 is fixed to a ball 35 held against one end of a rocker arm 34 which is angularly movably supported on a rocker camshaft 33 fixedly mounted to the cylinder head 8. A tappet screw 36 threaded through the other end of the rocker arm 34 for adjustable axial movement is held against the upper end of the exhaust valve 14.

Figure 3:
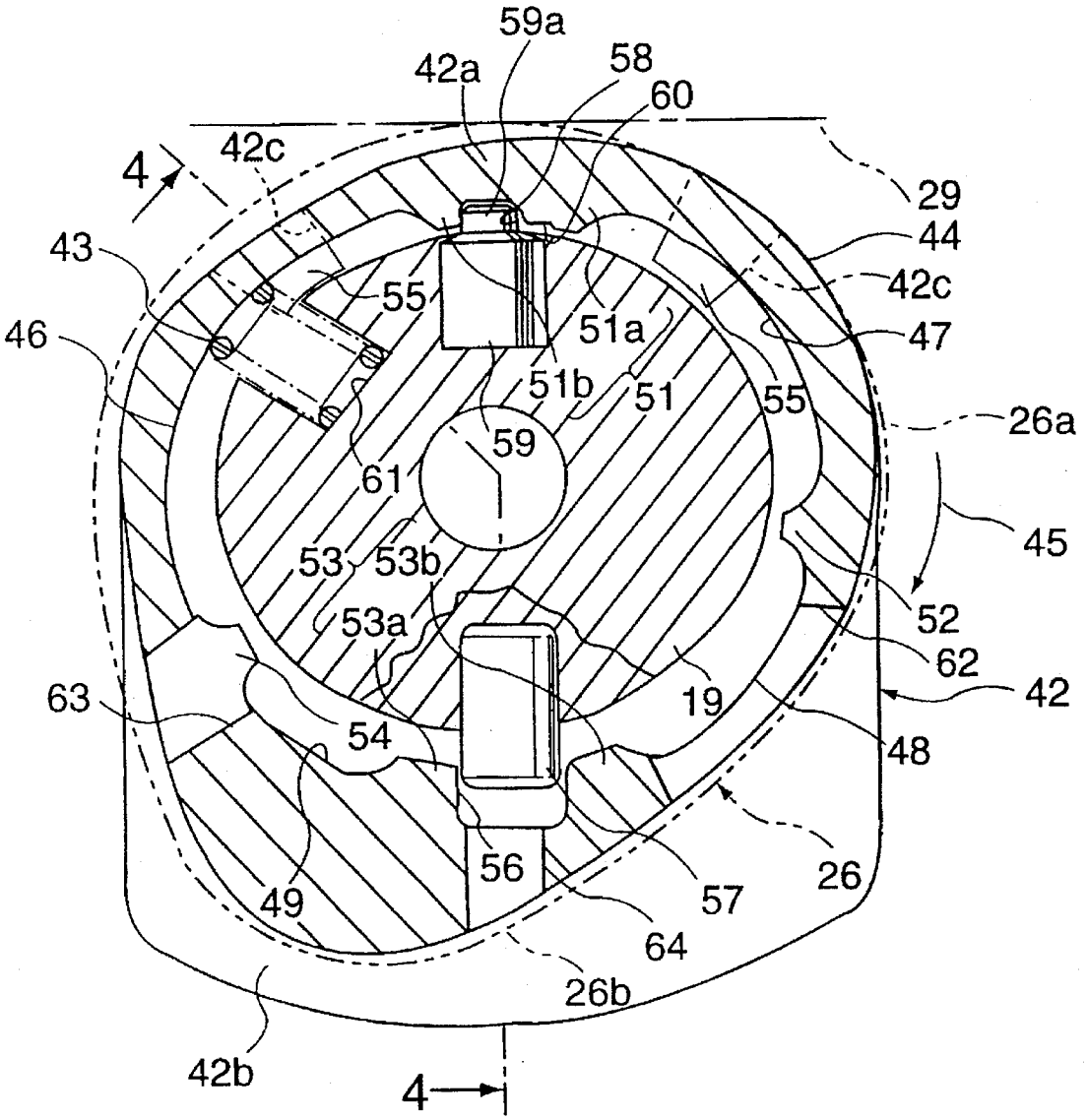
FIG. 3 is an enlarged cross-sectional view taken along line 3—3 of FIG. 2, showing parts during operation of the engine.

Referring to FIG. 3, the exhaust valve operating cam 26 has on its outer circumference a base-circle portion 26*a* spaced equidistantly from the axis of the camshaft 19 and a cam lobe 26*b* projecting radially outwardly from the base-circle portion 26*a*. When the tappet 29 engages the base-circle portion 26*a*, the exhaust valve 14 is closed. When the tappet 29 engages the cam lobe 26*b* and slides upwardly in the guide hole 28, the pushrod 31 angularly moves the rocker arm 34 in a direction to cause the tappet screw 36 to open the exhaust valve 14.

The crankcase 6 also has a guide hole 37 defined in a region thereof aligned with the intake valve operating cam 27, the guide hole 37 extends perpendicularly to the 35 axis of the camshaft 19. A tappet 38 held in abutment against the intake valve operating cam 27 is slidably fitted in the guide hole 37. A ball 40 fixed to the lower end of a vertically extending pushrod 39 is held against the tappet 38. The pushrod 39 has an upper end operatively coupled to the intake valve through a rocker arm (not shown) as with the exhaust valve 14.

A decompression cam 42 in the form of a ring surrounding the camshaft 19 is supported on the camshaft 19 between the bearing 22 and the exhaust valve operating cam 26. A spring 43 is disposed under compression between the decompression cam 42 and the camshaft 19.

Figure 4:
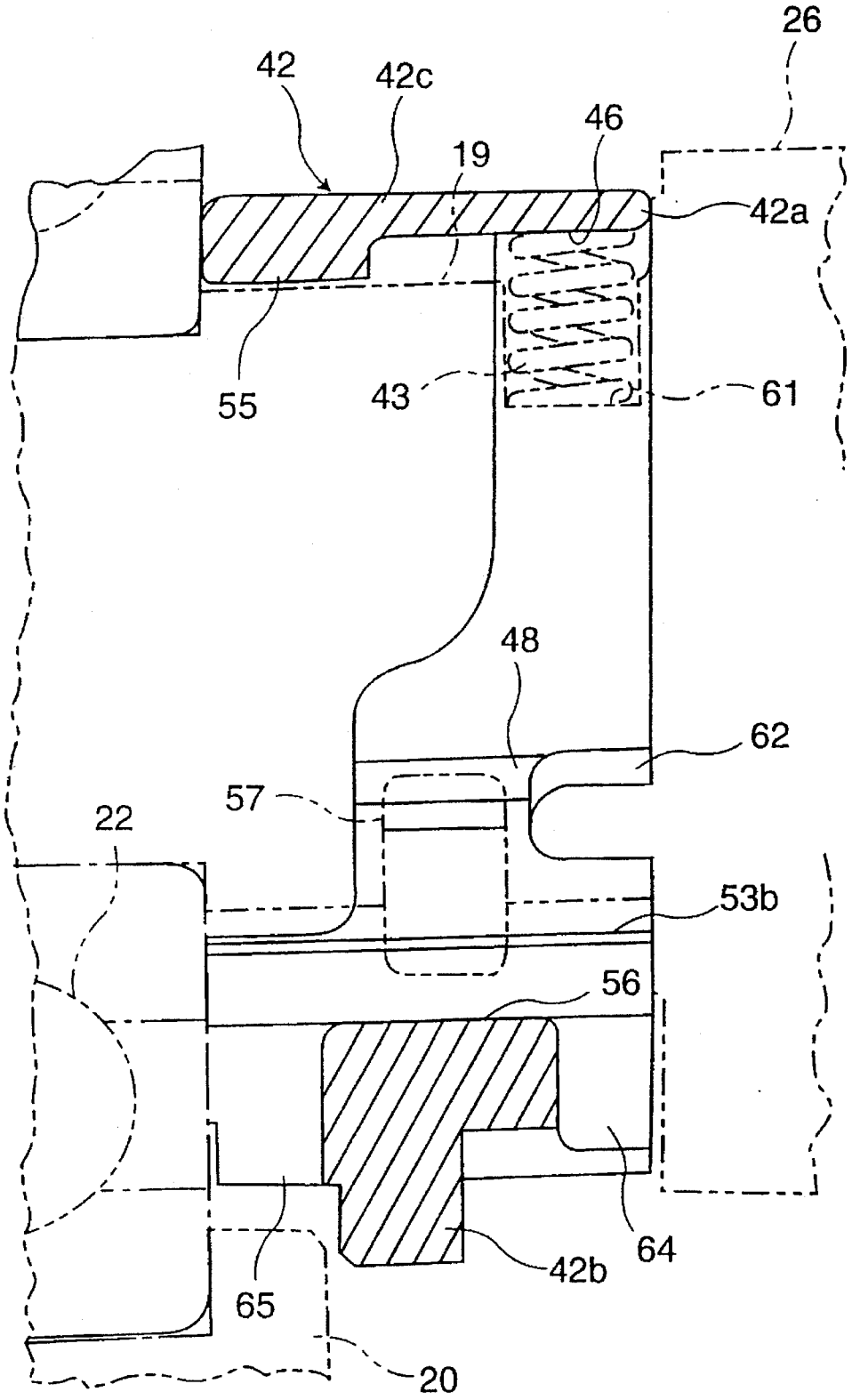
FIG. 4 is an enlarged cross-sectional view taken along line 4—4 of FIG. 3.
Figure 5:
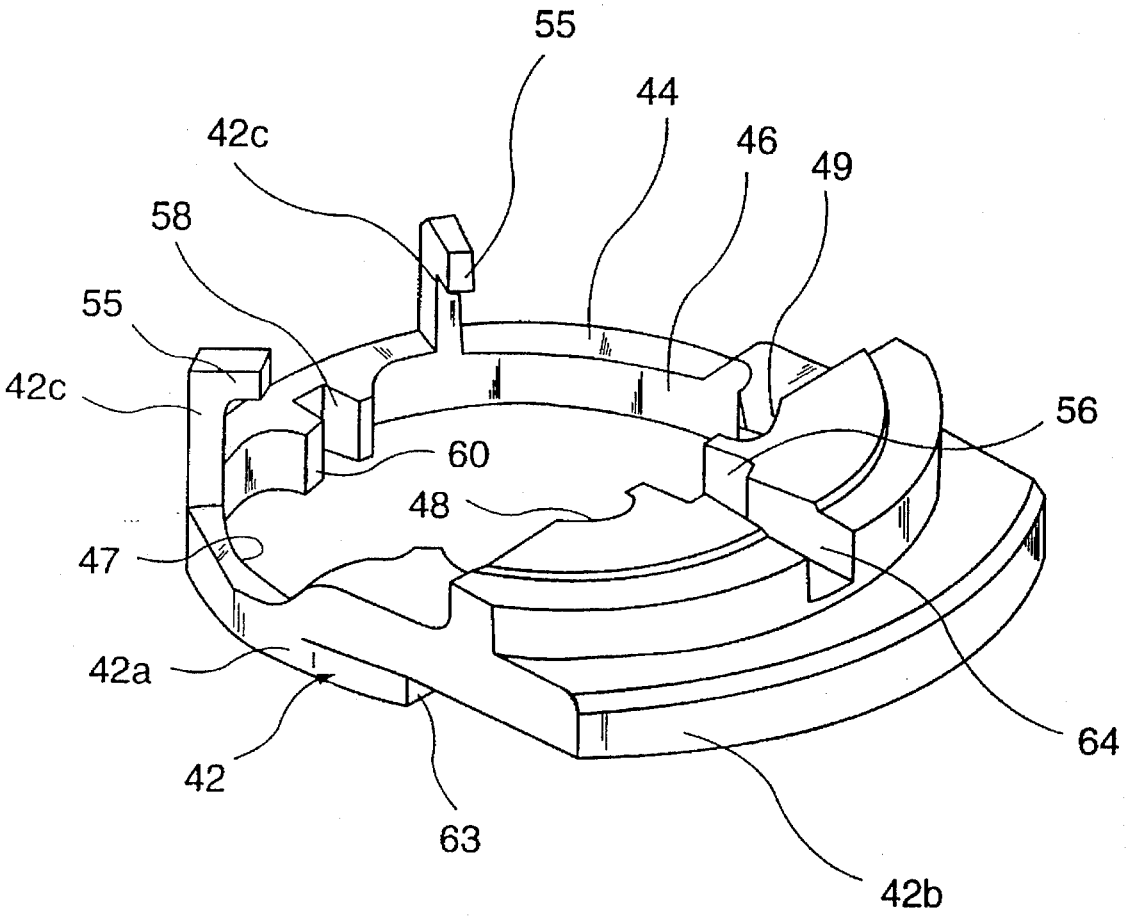
FIG. 5 is a perspective view of a decompression cam.

Referring to FIGS. 4 and 5, the decompression cam 42 comprises an arcuate portion 42*a* having a relatively small width and surrounding a substantially half circumferential surface of the camshaft 19 in a position near the exhaust valve operating cam 26. A counterweight 42*b* has a relatively large width extending between the exhaust valve operating cam 26 and the bearing 22 and surrounding substantially the remaining half circumferential surface of the camshaft 19. A pair of support arms 42*c* extend from the arcuate portion 42*a* toward the bearing 22.

The arcuate portion 42*a* has a cam surface 44 on its outer circumference corresponding to the base circle portion 26*a* of the exhaust valve operating cam 26 which is disposed adjacent to the decompression cam 42, the cam surface 44 being engageable with the tappet 29. The outer circumferential surface of the arcuate portion 42*a* including the cam surface 44 is of a shape substantially corresponding to the base circle portion 26*a* of the exhaust valve operating cam 26. The counterweight 42*b* has an outer circumferential surface close to the exhaust valve operating cam 26, which is of a shape substantially corresponding to the cam lobe 26*b* of the exhaust valve operating cam 26, but does not project radially outwardly beyond the cam lobe 26*b*, i.e., is held out of contact with the tappet 29. The counterweight 42*b* also has an outer circumferential surface close to the bearing 22, which is shaped out of contact with the support 20 of the crankcase 6. The counterweight 42*b* has a portion positioned substantially intermediate between the exhaust valve operating cam 26 and the bearing 22 and projecting radially outwardly beyond the exhaust valve operating cam 26 and the bearing 22.

The decompression cam 42 has a plurality of, e.g., four, elongated recesses 46, 47, 48, 49 (hereinafter referred to as recesses) defined at circumferentially spaced intervals on the inner circumferential surface thereof. The recesses 46, 47, 48, 49 are arranged successively in the direction, indicated by the arrow 45 in FIG. 3, in which the camshaft 19 rotates, and a plurality of lands 51, 52, 53, 54 disposed on the inner circumferential surface thereof between the recesses 46, 47, the recesses 47, 48, the recesses 48, 49 and the recesses 49, 46, respectively. The lands 51–54 have tip ends positioned on a hypothetical circle which has a diameter slightly larger than the outside diameter of the camshaft 19. The range of movement of the decompression cam 42 in a plane perpendicular to the axis of the camshaft 19 is limited by abutment of the lands 51–54 against the camshaft 19.

The recesses 46, 47 are defined in the arcuate portion 42*a* of the decompression cam 42 and extend between its opposite ends along the axis of the camshaft 19. With the decompression cam 42 positioned between the exhaust valve operating cam 26 and the bearing 22, the ends of the recesses 46, 47 near the exhaust valve operating cam 26 are closed by the exhaust valve operating cam 26. Since the arcuate portion 42 has a relatively small width near the exhaust valve operating cam 26, the ends of the recesses 46, 47 near the bearing 22 are open into a space defined between the bearing 22 and the arcuate portion 42*a*.

The support arms 42*c* are joined to the arcuate portion 42*a* one on each side of the land 51 positioned between the recesses 46, 47, and extend parallel to the axis of the camshaft 19. The support arms 42*c* have respective support fingers 55 on their distal ends near the bearing 22, the support fingers 55 being positioned along a hypothetical surface that has the same diameter as that of the hypothetical surface on which the tip ends of the lands 51–54 are positioned. The land 51 is disposed on the arcuate portion 42*a* at a position spaced from the cam surface 44 along the circumferential direction of the decompression cam 42 such that the land 51 will move across a region corresponding to the tappet 29 after the cam surface 44 moves across the region corresponding to the tappet 29 upon rotation of the decompression cam 42 in the direction indicated by the arrow 45.

The recesses 48, 49 are defined in a portion of the counterweight 42*b* of the decompression cam 42 which is wider than the arcuate portion 42*a* along the axis of the camshaft 19, but is spaced from the bearing 22 with the decompression cam 42 disposed between the exhaust valve operating cam 26 and the bearing 22. The ends of the recesses 48, 49 near the exhaust valve operating cam 26 are closed by the exhaust valve operating cam 26. However, the ends of the recesses 48, 49 near the bearing 22 are open into a space between the bearing 22 and the decompression cam 42. The counterweight 42*b* has oil discharge passages 62, 63 in the form of grooves defined in a surface thereof which confronts the exhaust valve operating cam 26, the oil discharge passages 62, 63 having inner ends communicating with the recesses 48, 49 and outer ends opening at an outer circumferential surface of the counterweight 42*b*.

The land 53 is positioned between the recesses 48, 49 substantially opposite to the land 51 on the arcuate portion 42*a* across the axis of the camshaft 19. The land 53 has a support slot 56 defined therein between its opposite ends along the axis of the camshaft 19, the support slot 56 dividing the land 53 into two front and rear sections 53*a*, 53*b* with respect to the direction indicated by the arrow 45. A support pin 57 having an outside diameter slightly smaller than the width of the support slot 56 is mounted in the camshaft 19 with the axis of the support pin 57 extending perpendicularly to the axis of the camshaft 19. Therefore, the decompression cam 42 is movable in a direction along the axis of the support pin 57, i.e., in a direction perpendicularly to the axis of the camshaft 19, and angularly movable relatively to the camshaft 19 in a range in which the support pin 57 is limited by opposite sides of the support slot 54.

The opposite ends of the support slot 56 are substantially fully closed by the exhaust valve operating cam 26 and the bearing 22. In order to discharge oil trapped in the support slot 56 smoothly therefrom, an oil discharge groove 64 is defined in the surface of the counterweight 42*b* which faces the exhaust valve operating cam 26, the oil discharge groove 64 having an inner end communicating with one end of the support slot 56 and an outer end opening outwardly of the counterweight 42*b*, and an oil discharge groove 65 is defined in the surface of the counterweight 42*b* which faces the bearing 22, the oil discharge groove 65 having an inner end communicating with the other end of the support slot 56 and an outer end opening outwardly of the counterweight 42*b*.

The land 51 on the arcuate portion 42*a* has a fitting slot 58 defined therein between its opposite ends along the axis of the camshaft 19, the fitting slot 58 dividing the land 51 into two front and rear sections 51*a*, 51*b* with respect to the direction indicated by the arrow 45. A limit pin 59 which is mounted in the camshaft 19 has a smaller diameter fitting projection 59*a* projecting from the outer surface of the camshaft 19 for being fitted in the fitting slot 58. The front section 51*a* of the land 51 near the cam surface 44 has an engaging step 60 lying in its region joined to the fitting slot 58 for engagement with the smaller diameter fitting projection 59*a* upon removal thereof from the fitting slot 58.

The spring 43 is compressed between the recess 46 and the closed end of a spring retainer slot 61 defined in the camshaft 19. The decompression cam 42 is normally biased by the spring 43 to urge the cam surface 44 to project from the base circle portion 26*a* of the exhaust valve operating cam 26 into abutment against the tappet 29.

Figure 6:
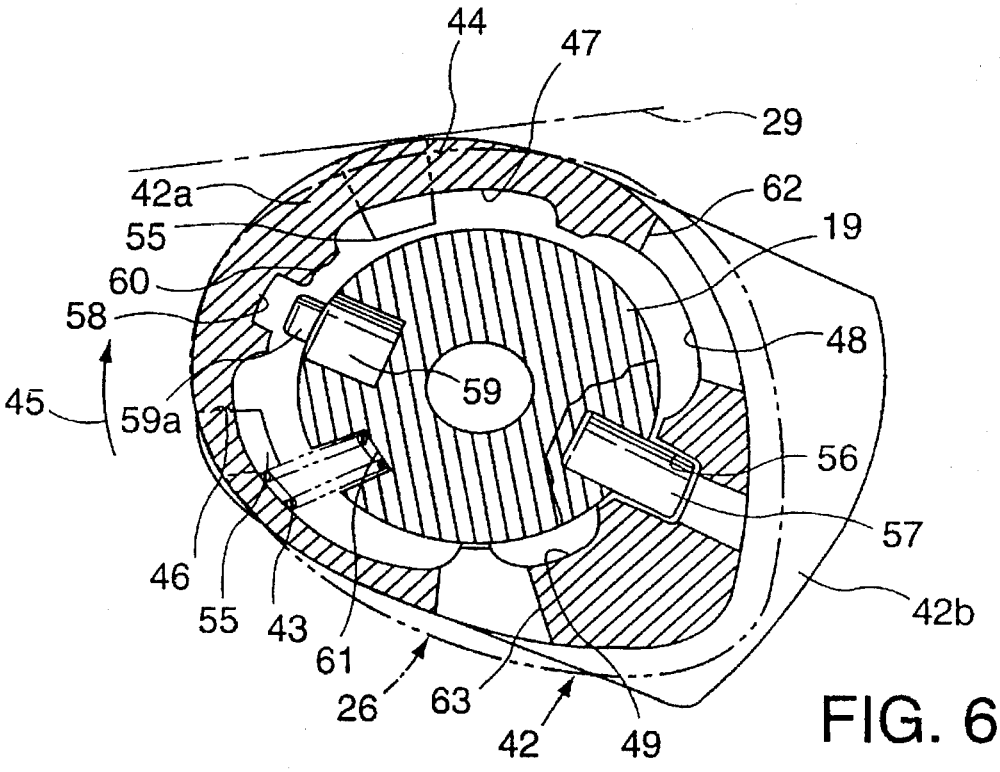
FIG. 6 is a cross-sectional view which corresponds to FIG. 3, showing parts immediately after the engine has started.
Figure 7:
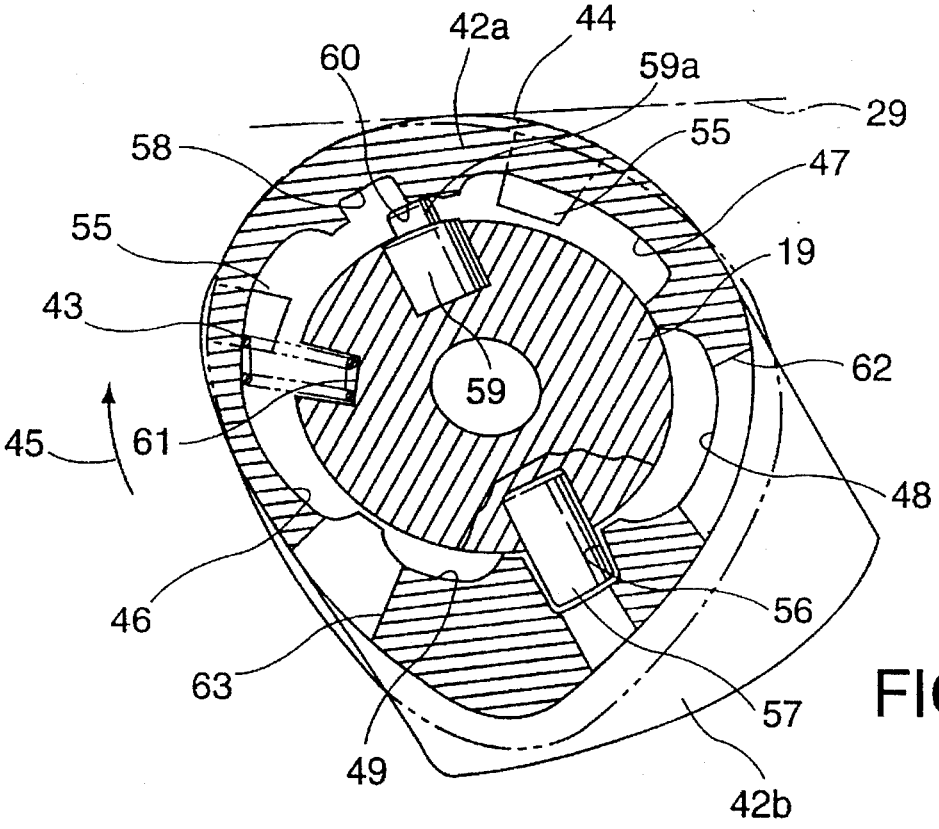
FIG. 7 is a cross-sectional view which corresponds to FIG. 3, showing parts upon continued rotation from the position shown in FIG. 6 after the engine has started.

When the engine is shut off, the decompression cam 42 is held in a stand by position in preparation for biasing opening the exhaust valve 14, in which the cam surface 44 projects from the base circle portion 26*a* of the exhaust valve operating cam 26 under the bias of the spring 43. When the engine starts, the decompression cam 42 rotates upon rotation of the camshaft 19 in the direction indicated by the arrow 45. In a first compression stroke immediately after the engine has started, as shown in FIG. 6, the tappet 29 engages the cam 44 of the decompression cam 42 which projects from the base circle portion 26*a* of the exhaust valve operating cam 26. Under reactive forces from the tappet 29, the decompression cam 42 angularly moves relatively to the camshaft 19 as shown in FIG. 7, into a biased valve opened position in which the smaller diameter fitting projection 59*a* of the limit pin 59 engages the engaging step 60.

Upon continued rotation of the camshaft 19, the decompression cam 42 is kept in the biased valve opening position by engagement of the limit pin 59 with the engaging step 60.

The cam surface 44 which projects from the base circle portion 26*a* pushes the pushrod 31, which biases open the exhaust valve 14 thereby to reduce the pressure in the combustion chamber 11.

When the cam surface 44 subsequently moves across the tappet 29, the decompression cam 42 is pushed by the tappet 29 to return to the position shown in FIG. 6. As the rotational speed of the camshaft 19 increases, centrifugal forces acting on the counterweight 42*b* overcome the spring forces of the spring 43, bringing the decompression cam 42 back to a position shown in FIG. 3 in which the smaller diameter fitting projection 59*a* of the limit pin 59 is fitted in the fitting slot 58, i.e., a retracted position in which the cam surface 44 is retracted inwardly of the base circle portion 26*a* of the exhaust valve operating cam 26. While the engine is normally operating after its start, the decompression cam 42 is held in the retracted position, and the exhaust cam 14 is opened and closed according to operating characteristics that are governed by the cam profile of the exhaust valve operating cam 26.

Advantages of the automatic decompression device according to the embodiment of the present invention will be described below. The plurality of, e.g., four, recesses 46–49 are defined at circumferentially spaced intervals in the inner circumferential surface of the decompression cam 42, the recesses 46–49 defining therebetween the lands 51–54 for limiting the range of movement of the decompression cam 42 in the planes perpendicular to the axis of the camshaft 19. Any clearance created between the camshaft 19 and the decompression cam 42 is relatively large except where the lands 51–54 are positioned. Consequently, the trapping of oil fully circumferentially between the camshaft 19 and the decompression cam 42 is minimized. Since the ends of the recesses 46–49 near the bearing 22 are open outwardly, any trapped oil can be discharged from the open ends of the recesses 46–49. Therefore, oil is effectively prevented from being trapped in the recesses 46–49.

When the engine restarts, the decompression cam 42 is prevented from sticking by means of oil to the camshaft 19. Since oil is prevented from being trapped, no oil pumping action occurs as the volume of the clearance between the camshaft 19 and the decompression cam 42 varies due to movement of the biased valve from the opened position to the retracted position, with the result that the decompression cam 42 can operate smoothly. As a consequence, an engine starter such as a cell starter, a recoil starter, or the like combined with the engine may be simplified in structure or reduced in size.

The counterweight 42*b* of the decompression cam 42 has a relatively large width along the axis of the camshaft 19, and the recesses 48, 49 defined in the counterweight 42*b* are relatively long while their ends near the bearing 22 are open outwardly. Inasmuch as the counterweight 42*b* has the oil discharge passages 62, 63 near the exhaust valve operating cam 26 for opening the recesses 48, 49 outwardly, oil can be discharged effectively from the relatively long recesses 48, 49.

While the embodiment of the present invention has been described above, the present invention is not limited to the above illustrated embodiment. Various design changes and modifications may be made in the embodiment without departing from the invention as recited in the scope of the claims for patent.

For example, the principles of the present invention are applicable to an automatic decompression device in which the intake valve is biased opened in a compression stroke by a decompression cam 42 disposed adjacent to the intake valve operating cam 27. The rocker arm operatively coupled to the exhaust valve 14 or the intake valve may be held as a follower against the decompression cam 42.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic decompression device for an engine comprising:

a camshaft having a valve operating cam for moving a cam follower operatively coupled to an exhaust valve;

a decompression cam having a ring shape surrounding the camshaft adjacent to the valve operating cam and including a cam surface engageable with said cam follower at a position corresponding to a base circle portion of the valve operating cam and a counterweight shaped out of contact with said cam follower and disposed substantially opposite to the cam surface across the axis of said camshaft; and a spring disposed under compression between the camshaft and the decompression cam for normally urging the decompression cam in a direction to cause the cam surface to project beyond the base circle portion of the valve operating cam;

said decompression cam being supported on said camshaft for movement between a biased valve opening position in which the decompression cam causes the cam surface to project beyond the base circle portion of the valve operating cam to bias open the exhaust valve in a compression stroke of the engine, and a retracted position in which the decompression cam retracts the cam surface inwardly of the base circle portion of the valve operating cam under centrifugal forces acting on said counterweight against spring forces of said spring when the engine operates at a relatively high rotational speed;

said decompression cam including a plurality of elongated recesses defined at circumferentially spaced positions on an inner circumferential surface thereof, said elongated recesses forming therebetween a plurality of lands for limiting the range of movement of the decompression cam in a plane perpendicular to the axis of the camshaft.

2. The automatic decompression device according to claim 1, wherein the elongated recesses of the decompression cam are open outwardly at at least one end thereof along the axis of the camshaft.

3. The automatic decompression device according to claim 1, wherein the decompression cam is supported on the camshaft while being limited against axial movement by the valve operating cam and a bearing interposed between a support of an engine body and the camshaft, and wherein the counterweight is disposed between the valve operating cam and the bearing and has oil discharge passages having inner ends communicating with the recesses defined in an inner circumferential surface of the counterweight and outer ends opening at an outer circumferential surface of the counterweight.

4. The automatic decompression device according to claim 1, wherein said cam follower includes a tappet in operative engagement with said cam surface.

5. The automatic decompression device according to claim 1, wherein said cam surface is formed by an arcuate portion extending around substantially half of the circumferential surface of said camshaft.

6. The automatic decompression device according to claim 5, wherein said arcuate portion includes at least one support arm projecting along the axis of said camshaft for spacing said decompression cam for a bearing mounted relative to said camshaft.

7. The automatic decompression device according to claim 1, wherein said plurality of lands define a hypothetical circle having a diameter slightly larger than the outside diameter of the camshaft.

8. The automatic decompression device according to claim 6, wherein said at least one support arm includes a support finger which projects a predetermined distance for defining a hypothetical surface having the same diameter as said hypothetical circle.

9. The automatic decompression device according to claim 1, wherein said decompression cam includes a support slot having a support pin operatively disposed therein, said support pin limits the movement of said decompression cam in a direction substantially perpendicular to the axis of said camshaft.

10. The automatic decompression device according to claim 1, and further including a limit pin mounted to project from said camshaft for engagement with an engaging step to assist in the opening of said intake valve.

11. An automatic decompression device for an engine comprising:

a camshaft having a valve operating cam for moving a cam follower operatively coupled to an intake valve;

a decompression cam having a ring shape surrounding the camshaft adjacent to the valve operating cam and including a cam surface engageable with said cam follower at a position corresponding to a base circle portion of the valve operating cam and counterweight shaped out of contact with said cam follower and disposed substantially opposite to the cam surface across the axis of said camshaft; and a spring disposed under compression between the camshaft and the decompression cam for normally urging the decompression cam in a direction to cause the cam surface to project beyond the base circle portion of the valve operating cam;

said decompression cam being supported on said camshaft for movement between a biased valve opening position in which the decompression cam causes the cam surface to project beyond the base circle portion of the valve operating cam to bias open the intake value in a compression stroke of the engine, and a retracted position in which the decompression cam retracts the cam surface inwardly of the base circle portion of the valve operating cam under centrifugal forces acting on said counterweight against spring forces of said spring when the engine operates at a relatively high rotational speed;

said decompression cam including a plurality of elongated recesses defined at circumferentially spaced positions in an inner circumferential surface thereof, said elongated recesses forming therebetween a plurality of lands for limiting the range of movement of the decompression cam in a plane perpendicular to the axis of the camshaft.

12. The automatic decompression device according to claim 11, wherein the elongated recesses of the decompression cam are open outwardly at at least one end thereof along the axis of the camshaft.

13. The automatic decompression device according to claim 11, wherein the decompression cam is supported on the camshaft while being limited against axial movement by the valve operating cam and a bearing interposed between a support of an engine body and the camshaft, and wherein the counterweight is disposed between the valve operating cam and the bearing and has oil discharge passages having inner ends communicating with the recesses defined in an inner circumferential surface of the counterweight and outer ends opening at an outer circumferential surface of the counterweight.

14. The automatic decompression device according to claim 11, wherein said cam follower includes a tappet in operative engagement with said cam surface.

15. The automatic decompression device according to claim 11, wherein said cam surface is formed by an arcuate portion extending around substantially half of the circumferential surface of said camshaft.

16. The automatic decompression device according to claim 15, wherein said arcuate portion includes at least one support arm projecting along the axis of said camshaft for spacing said decompression cam for a bearing mounted relative to said camshaft.

17. The automatic decompression device according to claim 16, wherein said at least one support arm includes a support finger which projects a predetermined distance for defining a hypothetical surface having the same diameter as said hypothetical circle.

18. The automatic decompression device according to claim 11, wherein said plurality of lands define a hypothetical circle having a diameter slightly larger than the outside diameter of the camshaft.

19. The automatic decompression device according to claim 11, wherein said decompression cam includes a support slot having a support pin operatively disposed therein, said support pin limits the movement of said decompression cam in a direction substantially perpendicular to the axis of said camshaft.

20. The automatic decompression device according to claim 11, and further including a limit pin mounted to project from said camshaft for engagement with an engaging step to assist in the opening of said intake valve.

21. An automatic decompression device for an engine comprising:

a camshaft having a valve operating cam for moving a cam follower operatively coupled to an exhaust valve;

a decompression cam having a ring shape surrounding the camshaft adjacent to the valve operating cam and including a cam surface engageable with said cam follower at a position corresponding to a base circle portion of the valve operating cam and a counterweight shaped out of contact with said cam follower and disposed substantially opposite to the cam surface across the axis of said camshaft; and a spring disposed under compression between the camshaft and the decompression cam for normally urging the decompression cam in a direction to cause the cam surface to project beyond the base circle portion of the valve operating cam;

said decompression cam being supported on said camshaft for movement between a biased valve opening position in which the decompression cam causes the cam surface to project beyond the base circle portion of the valve operating cam to bias open the exhaust valve in a compression stroke of the engine, and a retracted position in which the decompression cam retracts the cam surface inwardly of the base circle portion of the valve operating cam under centrifugal forces acting on said counterweight against spring forces of said spring when the engine operates at a relatively high rotational speed;

said decompression cam including a plurality of recesses defined at circumferentially spaced positions on an inner circumferential surface thereof, said recesses forming therebetween a plurality of lands for limiting the range of movement of the decompression cam in a plane perpendicular to the axis of the camshaft;

wherein the decompression cam is supported on the camshaft while being limited against axial movement by the valve operating cam and a bearing is interposed between a support of an engine body and the camshaft, and wherein the counterweight is disposed between the valve operating cam and the bearing and has oil discharge passages having inner ends communicating with the recesses defined in an inner circumferential surface of the counterweight and outer ends opening at an outer circumferential surface of the counterweight.

22. The automatic decompression device according to claim 21, wherein the recesses of the decompression cam are open outwardly at at least one end thereof along the axis of the camshaft.

23. The automatic decompression device according to claim 21, wherein said cam follower includes a tappet in operative engagement with said cam surface.

24. The automatic decompression device according to claim 21, wherein said cam surface is formed by an arcuate portion extending around substantially half of the circumferential surface of said camshaft.

25. An automatic decompression device for an engine comprising:

a camshaft having a valve operating cam for moving a cam follower operatively coupled to an exhaust valve;

a decompression cam having a ring shape surrounding the camshaft adjacent to the valve operating cam and including a cam surface engageable with said cam follower at a position corresponding to a base circle portion of the valve operating cam and a counterweight shaped out of contact with said cam follower and disposed substantially opposite to the cam surface across the axis of said camshaft; and a spring disposed under compression between the camshaft and the decompression cam for normally urging the decompression cam in a direction to cause the cam surface to project beyond the base circle portion of the valve operating cam;

said decompression cam being supported on said camshaft for movement between a biased valve opening position in which the decompression cam causes the cam surface to project beyond the base circle portion of the valve operating cam to bias open the exhaust valve in a compression stroke of the engine, and a retracted position in which the decompression cam retracts the cam surface inwardly of the base circle portion of the valve operating cam under centrifugal forces acting on said counterweight against spring forces of said spring when the engine operates at a relatively high rotational speed;

said decompression cam including a plurality of recesses defined at circumferentially spaced positions on an inner circumferential surface thereof, said recesses forming therebetween a plurality of lands for limiting the range of movement of the decompression cam in a plane perpendicular to the axis of the camshaft;

said cam surface being formed by an arcuate portion extending around substantially half of the circumferential surface of said camshaft and said arcuate portion includes at least one support arm projecting along the axis of said camshaft for spacing said decompression cam for a bearing mounted relative to said camshaft.

26. The automatic decompression device according to claim 25, wherein the recesses of the decompression cam are open outwardly at at least one end thereof along the axis of the camshaft.

27. The automatic decompression device according to claim 25, wherein the decompression cam is supported on the camshaft while being limited against axial movement by the valve operating cam and a bearing is interposed between a support of an engine body and the camshaft, and wherein the counterweight is disposed between the valve operating cam and the bearing and has oil discharge passages having inner ends communicating with the recesses defined in an inner circumferential surface of the counterweight and outer ends opening at an outer circumferential surface of the counterweight.

28. The automatic decompression device according to claim 25, wherein said plurality of lands define a hypothetical circle having a diameter slightly larger than the outside diameter of the camshaft.

29. The automatic decompression device according to claim 25, wherein said at least one support arm includes a support finger which projects a predetermined distance for defining a hypothetical surface having the same diameter as said hypothetical circle.

30. The automatic decompression device according to claim 25, wherein said decompression cam includes a support slot having a support pin operatively disposed therein, said support pin limits the movement of said decompression cam in a direction substantially perpendicular to the axis of said camshaft.

31. An automatic decompression device for an engine comprising:

a camshaft having a valve operating cam for moving a cam follower operatively coupled to an exhaust valve;

a decompression cam having a ring shape surrounding the camshaft adjacent to the valve operating cam and including a cam surface engageable with said cam follower at a position corresponding to a base circle portion of the valve operating cam and a counterweight shaped out of contact with said cam follower and disposed substantially opposite to the cam surface across the axis of said camshaft;

a spring disposed under compression between the camshaft and the decompression cam for normally urging the decompression cam in a direction to cause the cam surface to project beyond the base circle portion of the valve operating cam;

said decompression cam being supported on said camshaft for movement between a biased valve opening position in which the decompression cam causes the cam surface to project beyond the base circle portion of the valve operating cam to bias open the exhaust valve in a compression stroke of the engine, and a retracted position in which the decompression cam retracts the cam surface inwardly of the base circle portion of the valve operating cam under centrifugal forces acting on said counterweight against spring forces of said spring when the engine operates at a relatively high rotational speed;

said decompression cam including a plurality of recesses defined at circumferentially spaced positions on an inner circumferential surface thereof, said recesses forming therebetween a plurality of lands for limiting the range of movement of the decompression cam in a plane perpendicular to the axis of the camshaft; and a limit pin mounted to project from said camshaft for engagement with an engaging step to assist in the opening of said exhaust valve.

32. The automatic decompression device according to claim 31, wherein the recesses of the decompression cam are open outwardly at at least one end thereof along the axis of the camshaft.

33. The automatic decompression device according to claim 31, wherein the decompression cam is supported on the camshaft while being limited against axial movement by the valve operating cam and a bearing is interposed between a support of an engine body and the camshaft, and wherein the counterweight is disposed between the valve operating cam and the bearing and has oil discharge passages having inner ends communicating with the recesses defined in an inner circumferential surface of the counterweight and outer ends opening at an outer circumferential surface of the counterweight.

34. The automatic decompression device according to claim 31, wherein said cam follower includes a tappet in operative engagement with said cam surface.

35. The automatic decompression device according to claim 31, wherein said cam surface is formed by an arcuate portion extending around substantially half of the circumferential surface of said camshaft.

36. The automatic decompression device according to claim 31, wherein said plurality of lands define a hypothetical circle having a diameter slightly larger than the outside diameter of the camshaft.

37. The automatic decompression device according to claim 31, wherein said arcuate portion includes at least one support arm with a support finger which projects a predetermined distance for defining a hypothetical surface having the same diameter as said hypothetical circle.

38. The automatic decompression device according to claim 31, wherein said decompression cam includes a support slot having a support pin operatively disposed therein, said support pin limits the movement of said decompression cam in a direction substantially perpendicular to the axis of said camshaft.

39. An automatic decompression device for an engine comprising:

a camshaft having a valve operating cam for moving a cam follower operatively coupled to an intake valve;

a decompression cam having a ring shape surrounding the camshaft adjacent to the valve operating cam and including a cam surface engageable with said cam follower at a position corresponding to a base circle portion of the valve operating cam and a counterweight shaped out of contact with said cam follower and disposed substantially opposite to the cam surface across the axis of said camshaft; and a spring disposed under compression between the camshaft and the decompression cam for normally urging the decompression cam in a direction to cause the cam surface to project beyond the base circle portion of the valve operating cam;

said decompression cam being supported on said camshaft for movement between a biased valve opening position in which the decompression cam causes the cam surface to project beyond the base circle portion of the valve operating cam to bias open the intake valve in a compression stroke of the engine, and a retracted position in which the decompression cam retracts the cam surface inwardly of the base circle portion of the valve operating cam under centrifugal forces acting on said counterweight against spring forces of said spring when the engine operates at a relatively high rotational speed;

said decompression cam including a plurality of recesses defined at circumferentially spaced positions on an inner circumferential surface thereof, said recesses forming therebetween a plurality of lands for limiting the range of movement of the decompression cam in a plane perpendicular to the axis of the camshaft;

wherein the decompression cam is supported on the camshaft while being limited against axial movement by the valve operating cam and a bearing is interposed between a support of an engine body and the camshaft, and wherein the counterweight is disposed between the valve operating cam and the bearing and has oil discharge passages having inner ends communicating with the recesses defined in an inner circumferential surface of the counterweight and outer ends opening at an outer circumferential surface of the counterweight.

40. The automatic decompression device according to claim 39, wherein the recesses of the decompression cam are open outwardly at at least one end thereof along the axis of the camshaft.

41. The automatic decompression device according to claim 39, wherein said cam follower includes a tappet in operative engagement with said cam surface.

42. The automatic decompression device according to claim 39, wherein said cam surface is formed by an arcuate portion extending around substantially half of the circumferential surface of said camshaft.

43. An automatic decompression device for an engine comprising:

a camshaft having a valve operating cam for moving a cam follower operatively coupled to an intake valve;

a decompression cam having a ring shape surrounding the camshaft adjacent to the valve operating cam and including a cam surface engageable with said cam follower at a position corresponding to a base circle portion of the valve operating cam and a counterweight shaped out of contact with said cam follower and disposed substantially opposite to the cam surface across the axis of said camshaft; and a spring disposed under compression between the camshaft and the decompression cam for normally urging the decompression cam in a direction to cause the cam surface to project beyond the base circle portion of the valve operating cam;

said decompression cam being supported on said camshaft for movement between a biased valve opening position in which the decompression cam causes the cam surface to project beyond the base circle portion of the valve operating cam to bias open the intake valve in a compression stroke of the engine, and a retracted position in which the decompression cam retracts the cam surface inwardly of the base circle portion of the valve operating cam under centrifugal forces acting on said counterweight against spring forces of said spring when the engine operates at a relatively high rotational speed;

said decompression cam including a plurality of recesses defined at circumferentially spaced positions on an inner circumferential surface thereof, said recesses forming therebetween a plurality of lands for limiting the range of movement of the decompression cam in a plane perpendicular to the axis of the camshaft;

said cam surface being formed by an arcuate portion extending around substantially half of the circumferential surface of said camshaft and said arcuate portion includes at least one support arm projecting along the axis of said camshaft for spacing said decompression cam for a bearing mounted relative to said camshaft.

44. The automatic decompression device according to claim 43, wherein the recesses of the decompression cam are open outwardly at at least one end thereof along the axis of the camshaft.

45. The automatic decompression device according to claim 43, wherein the decompression cam is supported on the camshaft while being limited against axial movement by the valve operating cam and a bearing is interposed between a support of an engine body and the camshaft, and wherein the counterweight is disposed between the valve operating cam and the bearing and has oil discharge passages having inner ends communicating with the recesses defined in an inner circumferential surface of the counterweight and outer ends opening at an outer circumferential surface of the counterweight.

46. The automatic decompression device according to claim 43, wherein said plurality of lands define a hypothetical circle having a diameter slightly larger than the outside diameter of the camshaft.

47. The automatic decompression device according to claim 43, wherein said at least one support arm includes a support finger which projects a predetermined distance for defining a hypothetical surface having the same diameter as said hypothetical circle.

48. The automatic decompression device according to claim 43, wherein said decompression cam includes a support slot having a support pin operatively disposed therein, said support pin limits the movement of said decompression cam in a direction substantially perpendicular to the axis of said camshaft.

49. An automatic decompression device for an engine comprising:

a camshaft having a valve operating cam for moving a cam follower operatively coupled to an intake valve;

a decompression cam having a ring shape surrounding the camshaft adjacent to the valve operating cam and including a cam surface engageable with said cam follower at a position corresponding to a base circle portion of the valve operating cam and a counterweight shaped out of contact with said cam follower and disposed substantially opposite to the cam surface across the axis of said camshaft;

a spring disposed under compression between the camshaft and the decompression cam for normally urging the decompression cam in a direction to cause the cam surface to project beyond the base circle portion of the valve operating cam;

said decompression cam being supported on said camshaft for movement between a biased valve opening position in which the decompression cam causes the cam surface to project beyond the base circle portion of the valve operating cam to bias open the intake valve in a compression stroke of the engine, and a retracted position in which the decompression cam retracts the cam surface inwardly of the base circle portion of the valve operating cam under centrifugal forces acting on said counterweight against spring forces of said spring when the engine operates at a relatively high rotational speed;

said decompression cam including a plurality of recesses defined at circumferentially spaced positions on an inner circumferential surface thereof, said recesses forming therebetween a plurality of lands for limiting the range of movement of the decompression cam in a plane perpendicular to the axis of the camshaft; and a limit pin mounted to project from said camshaft for engagement with an engaging step to assist in the opening of said intake valve.

50. The automatic decompression device according to claim 49, wherein the recesses of the decompression cam are open outwardly at at least one end thereof along the axis of the camshaft.

51. The automatic decompression device according to claim 49, wherein the decompression cam is supported on the camshaft while being limited against axial movement by the valve operating cam and a bearing is interposed between a support of an engine body and the camshaft, and wherein the counterweight is disposed between the valve operating cam and the bearing and has oil discharge passages having inner ends communicating with the recesses defined in an inner circumferential surface of the counterweight and outer ends opening at an outer circumferential surface of the counterweight.

52. The automatic decompression device according to claim 49, wherein said cam follower includes a tappet in operative engagement with said cam surface.

53. The automatic decompression device according to claim 49, wherein said cam surface is formed by an arcuate portion extending around substantially half of the circumferential surface of said camshaft.

54. The automatic decompression device according to claim 49, wherein said plurality of lands define a hypothetical circle having a diameter slightly larger than the outside diameter of the camshaft.

55. The automatic decompression device according to claim 49, wherein said arcuate portion includes at least one support arm with a support finger which projects a predetermined distance for defining a hypothetical surface having the same diameter as said hypothetical circle.

56. The automatic decompression device according to claim 49, wherein said decompression cam includes a support slot having a support pin operatively disposed therein, said support pin limits the movement of said decompression cam in a direction substantially perpendicular to the axis of said camshaft.

* * * * *